US006543315B2

(12) United States Patent
Huang

(10) Patent No.: US 6,543,315 B2
(45) Date of Patent: Apr. 8, 2003

(54) RATCHET STRUCTURE OF SCREWDRIVER

(76) Inventor: Ping Wen Huang, 1F, No. 364, Sec. 2, Chung Yang Road, Hsien-Hsi Tsun, Chang-Hua Hsien (TW)

( * ) Notice: Subject to any disclaimer, the term of this patent is extended or adjusted under 35 U.S.C. 154(b) by 0 days.

(21) Appl. No.: 10/147,060

(22) Filed: May 17, 2002

(65) Prior Publication Data

US 2002/0194964 A1 Dec. 26, 2002

(30) Foreign Application Priority Data

Jun. 21, 2001 (TW) ..... 90210620 U

(51) Int. Cl.[7] ..... B25B 13/46

(52) U.S. Cl. ..... 81/62; 81/58.4; 81/63.1; 192/43.2

(58) Field of Search ..... 81/58.4, 58, 60, 81/63.1, 62; 192/41, 43, 43.1, 43.2

(56) References Cited

U.S. PATENT DOCUMENTS 2,803,980 A * 8/1957 Vogel ..... 81/62
4,541,310 A * 9/1985 Lindenberger ..... 81/177.1
5,520,073 A * 5/1996 Bakula et al. ..... 81/58.1
5,531,139 A * 7/1996 Fanchang et al. ..... 81/59.1
5,535,648 A * 7/1996 Braun et al. ..... 81/60
5,570,616 A * 11/1996 Thompson et al. ..... 192/43.2

* cited by examiner

*Primary Examiner*—James G. Smith
*Assistant Examiner*—Hadi Shakeri
(74) *Attorney, Agent, or Firm*—Rosenberg, Klein & Lee

(57) ABSTRACT

A ratchet structure of a screwdriver includes a seat body disposed on a handle, a ratchet mechanism and an outer collar. The seat body has a stop wall projecting therefrom. The stop wall defines a central receiving space and an opening. The seat body has a projecting post at the opening to divide the opening into a left split and a right split. A stem is fitted in the receiving space. The ratchet mechanism includes a left dog and a right dog respectively disposed at the left and right splits. The post is formed with a left and a right projecting section. The middle sections of the left and right dogs are formed with left and right notches in which the left and right projecting sections are respectively cooperatively inlaid. The left and right dogs swing about the projecting sections to disengage from the toothed section of the stem.

3 Claims, 3 Drawing Sheets

RATCHET STRUCTURE OF SCREWDRIVER

BACKGROUND OF THE INVENTION

The present invention is related to an improved ratchet structure of a screwdriver in which the ratchet mechanism includes a left dog and a right dog. A left and a right projecting sections of a post are cooperatively inlaid in left and right notches of the middle sections of the left and right dogs. The left and right projecting sections serve as supports for the left and right dogs, whereby the ratchet screwdriver can be more truly operated and the torque value of the ratchet screwdriver is increased.

FIGS. 6 and 7 show a conventional ratchet screwdriver. The front end of the handle 81 has a seat body 82. A stem 83 is fitted in the seat body 82. A section of the stem 83 in the seat body 82 is a toothed section 831. The seat body 82 is formed with a cavity 821 in which a ratchet mechanism 9 is disposed. The ratchet mechanism 9 has two dogs 91. The wall of the cavity 821 is formed with two dented sections 822 in which the two dogs 91 are planted. The dented sections 822 serve as supports for the dogs 91, whereby the dogs 91 can swing about the sections abutting against the dented section 822. Two springs 92 are respectively disposed between two lateral walls of the cavity 821 and the two dogs 91. The springs 92 push the dogs 91 to engage with the toothed section 831 of the stem 83. A drive block 93 is disposed between the two dogs 91. One end of the drive block 93 extends out of the seat body 82 to couple with an outer collar 84 fitted around the seat body 82. By means of turning the outer collar 84, the drive block 93 is driven and rotated to respectively push and disengage the dogs 91 from the toothed section 831. Accordingly, the rotational direction of the stem 83 driven by the seat body 82 can be controlled.

The sections of the dogs 91 abutting against the dented sections 822 serve as supporting points for the dogs 91. The free ends of the dogs 91 engaged with the toothed section 831 of the stem 83 are opposite to the sections abutting against the dented sections 822. Accordingly, the arm of resistance of the dogs 91 engaged with the toothed section 831 is considerably long. Therefore, the dogs 91 are easy to deform or break when suffering too great force. Under such circumstance, the ratchet mechanism 9 will fail. Furthermore, the dogs 91 have considerable lengths and swing about the sections abutting against the dented sections 822. Therefore, the drive block 93 needs to push the dogs 91 to swing by a considerable amplitude so as to disengage from the toothed section 831. In the case that the drive block 93 is worn or the dogs 91 are deformed, it often takes place that the dogs 91 cannot be totally disengaged from the toothed section 831 of the stem 93. As a result, the screwdriver can be hardly truly operated.

SUMMARY OF THE INVENTION

It is therefore a primary object of the present invention to provide an improved ratchet structure of a screwdriver in which the left and right dogs of the ratchet mechanism are respectively disposed in the left and right splits defined between the stop wall and the post integrally projecting from the seat body. The post is formed with a left and a right projecting sections respectively corresponding to the left and right dogs and inlaid in the left and right notches of the middle sections of the left and right dogs. Accordingly, the post serves to support the left and right dogs, whereby the left and right dogs can swing about the projecting sections inlaid in the left and right notches of the middle sections of the left and right dogs. Therefore, the swinging amplitude of the left and right dogs is reduced and the ratchet screwdriver can be more truly operated.

It is a further object of the present invention to provide the above ratchet structure in which the left and right projecting sections of the post inlaid in the left and right notches of the middle sections of the left and right dogs serve as supports for the left and right dogs. Therefore, the arm of resistance of the left and right dogs engaged with the toothed section of the stem is shortened. Therefore, the left and right dogs can bear greater resistance and the torque value of the ratchet screwdriver is increased.

The present invention can be best understood through the following description and accompanying drawings wherein:

DETAILED DESCRIPTION OF THE PREFERRED EMBODIMENTS

Figure 1:
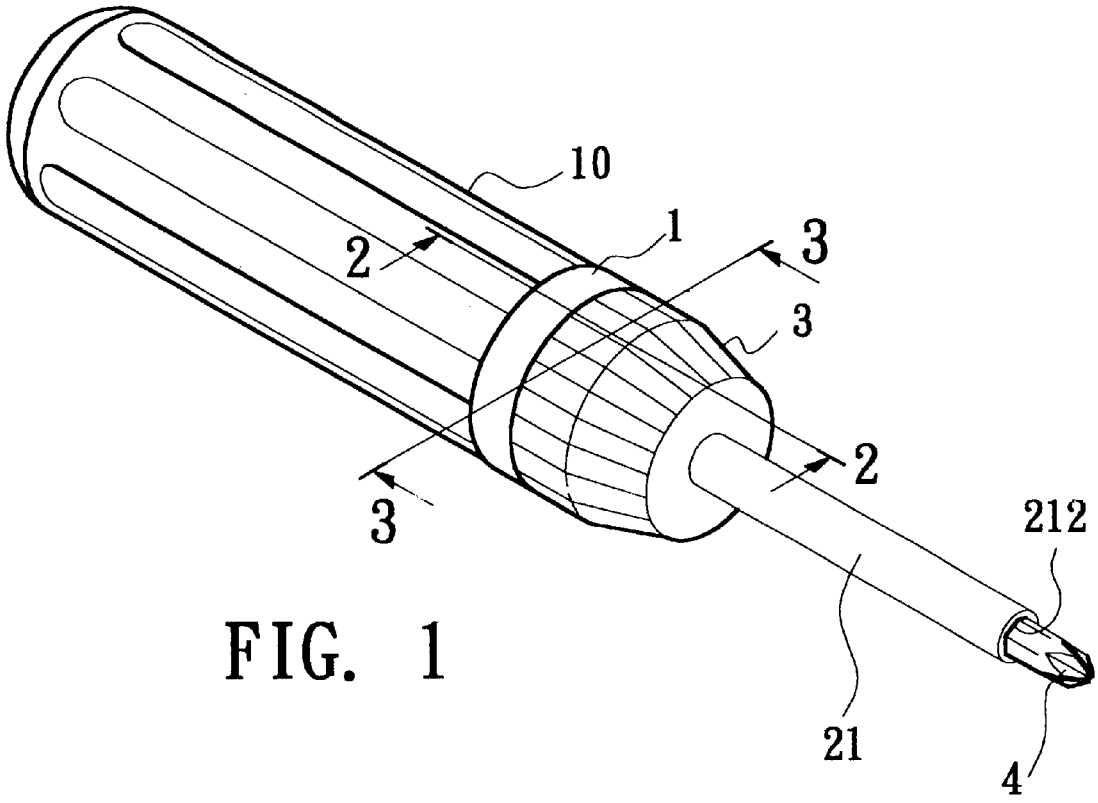
FIG. 1 is a perspective assembled view of the present invention.
Figure 2:
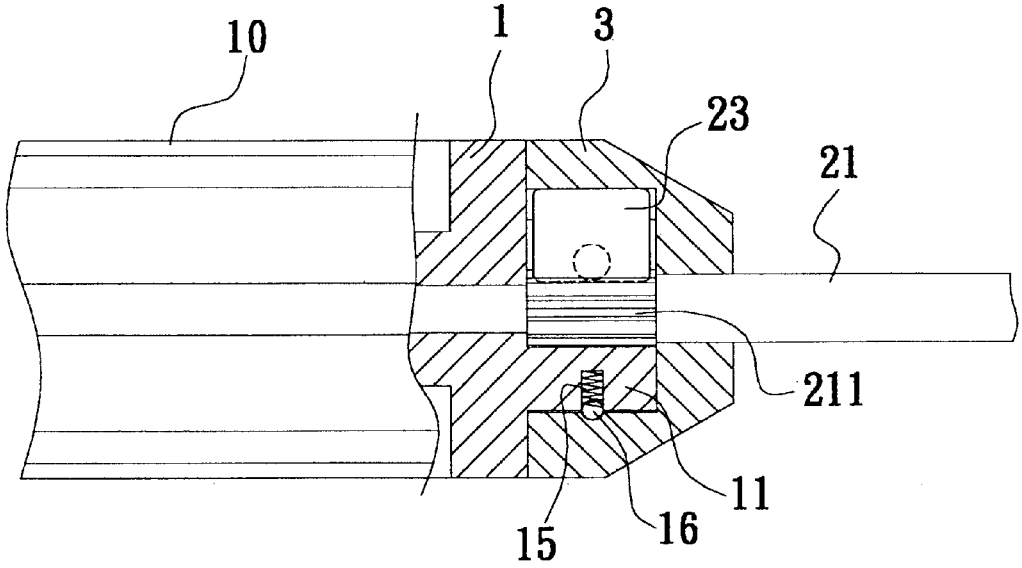
FIG. 2 is a sectional view taken along line 2—2 of FIG. 1.

Please refer to FIGS. 1 to 5. The ratchet structure of the screwdriver of the present invention includes a seat body 1, a ratchet mechanism 2 and an outer collar 3.

The seat body 1 is disposed on a handle 10. The seat body 1 has a substantially C-shaped stop wall 11 axially projecting from the seat body 1. The stop wall 11 defines a central cylindrical receiving space 12 and an opening 13 radially outward extending from the receiving space 12. The seat body 1 has an integrally projecting post 14 at the opening 13 to divide the opening 13 into a left split 131 and a right split 132. The stop wall 11 is formed with a left dent 111 and a right dent 112 respectively corresponding to the left and right splits 131, 132. In addition, the stop wall 11 is formed with a receptacle 113 inward extending from outer circumference of the stop wall 11. A spring 15 and a steel ball 16 are disposed in the receptacle 113. The steel ball 16 is outward pushed by the spring 15.

The ratchet mechanism 2 has a stem 21 fitted in the receiving space 12 of the seat body 1. The stem 21 has a toothed section 211 corresponding to the receiving space 12. One end of the stem 21 extending out of the seat body 1 has a bit connecting section 212 for connecting with a bit 4. The ratchet mechanism 2 includes a left dog 22 and a right dog 23 respectively at the left and right splits 131, 132 of the seat body 1. The left and right dogs 22, 23 are swingable. The post 14 of the seat body 1 is formed with a left and a right projecting sections 141, 142 respectively corresponding to the left and right dogs 22, 23. The middle sections of the left and right dogs 22, 23 are formed with left and right notches 221, 231 respectively corresponding to and in cooperation with the left and right projecting sections 141, 142. Two springs 24, 25 are respectively disposed in the left and right dents 111, 112 of the stop wall 11 for pushing the left and right dogs 22, 23 to engage with the toothed section 211 of the stem 21. The ends of the left and right dogs 22, 23 opposite to the ends engaging with the toothed section 211 respectively extend out of the left and right splits 131, 132.

The outer collar 3 is fitted around the stop wall 11 of the seat body 1 to cover the same. The outer collar 3 is formed with a recess 31 corresponding to the ends of the left and right dogs 22, 23 extending out of the left and right splits 131, 132. Two sides of the recess 31 are respectively formed with a left and a right stop faces 311, 312. When turning the outer collar 3, the left and right stop faces 311, 312 respectively push and deflect the left and right dogs 22, 23 to disengage from the toothed section 211 of the stem 21. Accordingly, the rotational direction of the stem 21 driven by the seat body 1 can be controlled. The stop wall 11 is formed with a left and a right abutting sections 114, 115 respectively corresponding to the left and right dogs 22, 23. When the left and right dogs 22, 23 are pushed by the left and right stop faces 311, 312 to disengage from the toothed section 211 of the stem 21, the left and right dogs 22, 23 abut against the left and right abutting sections 114, 115. The outer collar 3 is further formed with a left, a right and a middle locating sections 32, 33, 34 corresponding to the steel ball 16 of the stop wall 11. The left locating section 32 is formed in a position where the left stop face 311 of the recess 31 of the outer collar 3 pushes the left dog 22. The right locating section 33 is formed in a position where the right stop face 312 of the recess 31 of the outer collar 3 pushes the right dog 23. The middle locating section 34 is formed in a position where neither the left stop face 311 nor the right stop face 312 of the recess 31 of the outer collar 3 pushes the left dog 22 or the right dog 23. The steel ball 16 is pushed into any of the three locating sections to locate the outer collar 3.

Figure 3:
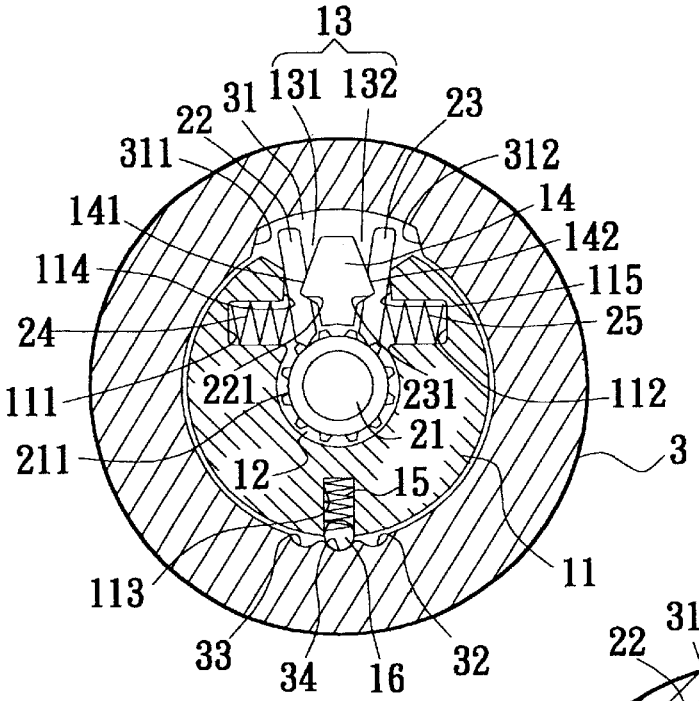
FIG. 3 is a sectional view taken along line 3—3 of FIG. 1, showing a first using state of the present invention.
Figure 4:
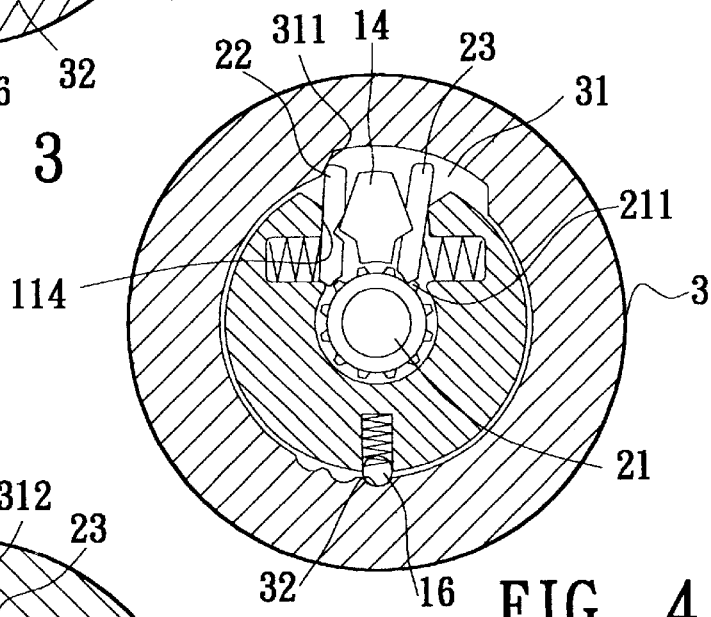
FIG. 4 is a sectional view according to FIG. 3, showing a second using state of the present invention.
Figure 5:
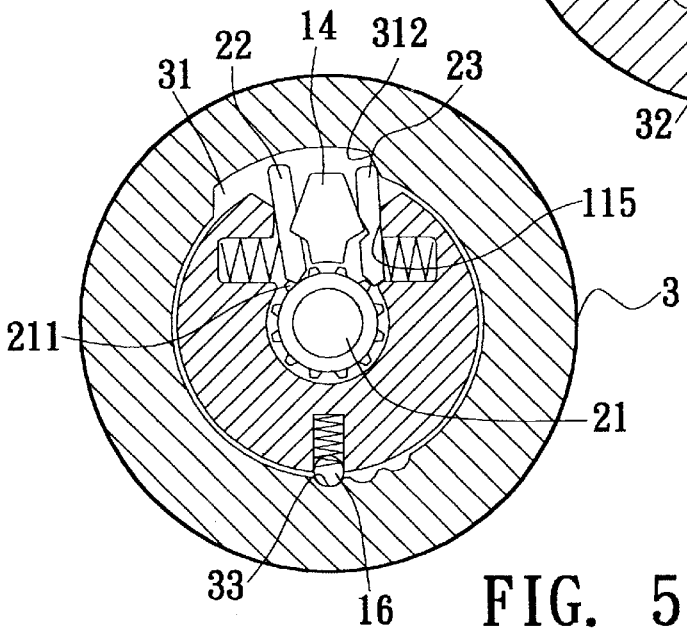
FIG. 5 is a sectional view according to FIG. 3, showing a third using state of the present invention.
Figure 6:
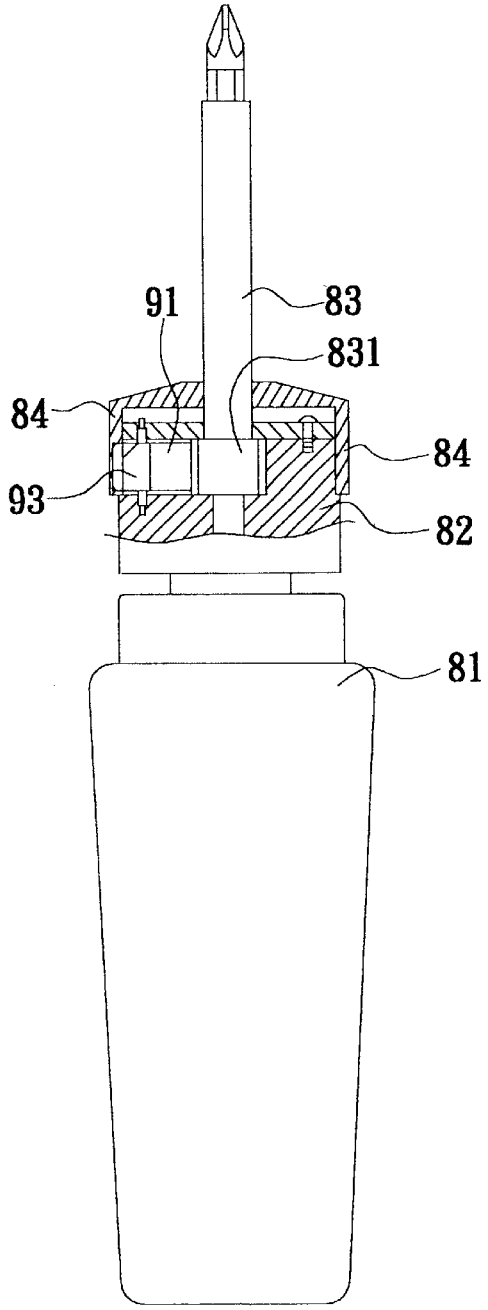
FIG. 6 PRIOR ART
FIG. 6 is a partially longitudinal sectional view of a conventional ratchet screwdriver.
Figure 7:
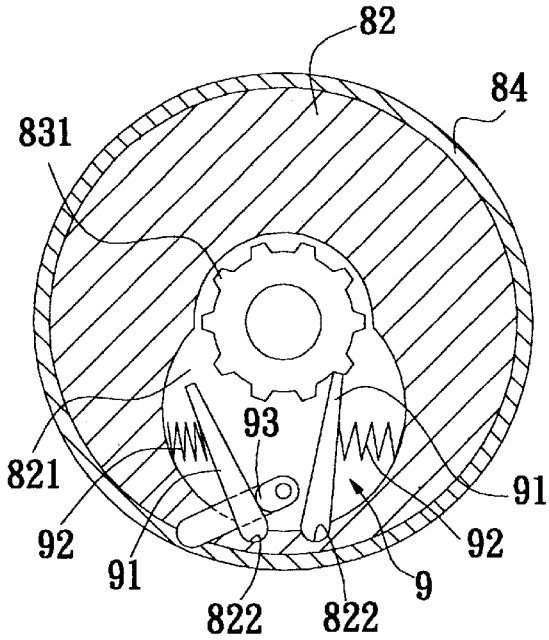
FIG. 7 PRIOR ART
FIG. 7 is a cross-sectional view of the conventional ratchet screwdriver.

In use, the outer collar 3 is turned to aim the middle locating section 34 at the steel ball 16. The steel ball 16 is pushed by the spring 15 and engaged in the middle locating section 34. At this time, neither the left stop face 311 nor the right stop face 312 of the recess 31 pushes the left dog 22 or the right dog 23, whereby the left and right dogs 22, 23 are respectively pushed by the springs 24, 25 to both engage with the toothed section 211 of the stem 21 as shown in FIG. 3. Accordingly, no matter whether a user clockwise or counterclockwise turns the handle 10 coupled with the seat body 1, the stem 21 is driven and rotated. When the outer collar 3 is turned to engage the steel ball 16 in the left locating section 32, the left stop face 311 of the recess 31 pushes the left dog 22, whereby the left dog 22 swings about the left projecting section 141 of the post 14 inlaid in the left notch 221 to abut against the left abutting section 114. After swinging, the left dog 22 disengages from the toothed section 211 and only the right dog 23 engages with the toothed section 211 as shown in FIG. 4. At this time, when the user clockwise turns the handle 10 coupled with the seat body 1, the seat body 1 is rotated and the right dog 23 drives the toothed section 211 to rotate the stem 21. Reversely, when the user counterclockwise turns the handle 10 coupled with the seat body 1, the seat body 1 is rotated and the toothed section 211 of the stem 21 will push away the right dog 23 so that the stem 21 will not be driven. When the outer collar 3 is turned to engage the steel ball 16 in the right locating section 33, the right stop face 312 of the recess 31 pushes the right dog 23, whereby the right dog 23 swings about the right projecting section 142 of the post 14 inlaid in the right notch 231 to abut against the right abutting section 115. After swinging, the right dog 23 disengages from the toothed section 211 and only the left dog 22 engages with the toothed section 211 as shown in FIG. 5. At this time, when the user clockwise turns the handle 10 coupled with the seat body 1, the seat body 1 is rotated and the toothed section 211 of the stem 21 will push away the left dog 22 so that the stem 21 will not be driven. Reversely, when the user counterclockwise turns the handle 10 coupled with the seat body 1, the seat body I is rotated and the left dog 22 drives the toothed section 211 to rotate the stem 21.

The left and right dogs 22, 23 of the ratchet mechanism 2 are respectively disposed in the left and right splits 131, 132 defined between the stop wall 11 and the post 14. The post 14 is formed with a left and a right projecting sections 141, 142 respectively corresponding to the left and right dogs 22, 23 and inlaid in the left and right notches 221, 231 thereof. Accordingly, the post 14 serves to support the left and right dogs 22, 23, whereby the left and right dogs 22, 23 can swing about the projecting sections 141, 142 inlaid in the middle sections of the left and right dogs 22, 23. Therefore, the swinging amplitude of the left and right dogs 22, 23 is reduced and the ratchet screwdriver can be more truly operated. Furthermore, the left and right projecting sections 141, 142 of the post 14 inlaid in the left and right notches 221, 231 of the middle sections of the left and right dogs 22, 23 serve as supports for the left and right dogs 22, 23. Therefore, the arm of resistance of the left and right dogs 22, 23 engaged with the toothed section 211 of the stem 21 is shortened, whereby the left and right dogs 22, 23 can bear greater resistance and the torque value of the ratchet screwdriver is increased.

The above embodiment is only used to illustrate the present invention, not intended to limit the scope thereof. Many modifications of the above embodiment can be made without departing from the spirit of the present invention.

What is claimed is:

1. A ratchet structure of a screwdriver, comprising:

a seat body disposed on a handle, the seat body having a substantially C-shaped stop wall axially projecting from the seat body, the stop wall defining a central cylindrical receiving space and an opening radially outward extending from the receiving space, the seat body having an integrally projecting post at the opening to divide the opening into a left split and a right split, the stop wall being formed with a left dent and a right dent respectively corresponding to the left and right splits, the stop wall being further formed with a receptacle inward extending from outer circumference of the stop wall, a spring and a steel ball being disposed in the receptacle, the steel ball being outward pushed by the spring;

a ratchet mechanism having a stem fitted in the receiving space of the seat body, the stem having a toothed section corresponding to the receiving space, the ratchet mechanism including a left dog and a right dog respectively disposed at the left and the right splits of the seat body, the left dog and the right dog each having opposing first and second ends, the post of the seat body being formed with a left and a right projecting sections respectively corresponding to the left and right dogs, middle sections of the left and the right dogs being formed with left and right notches respectively corresponding to and in cooperation with the left and right projecting sections, two springs being respectively disposed in the left and right dents of the stop wall for pushing the left and right dogs to engage the first ends of the left and right dogs with the toothed section of the stem, the second ends of the left and right dogs respectively engaging with the toothed section and respectively extending into the left and right splits; and an outer collar fitted around the stop wall of the seat body to cover the same, the outer collar being formed with a recess corresponding to the ends of the left and right dogs extending out of the left and right splits, two sides of the recess being respectively formed with a left and a right stop faces, when turning the outer collar, the left and right stop faces respectively pushing and deflecting the left and right dogs to disengage from the toothed section of he stem, whereby the rotational direction of the stem driven by the seat body can be controlled, the outer collar being further formed with a left, a right and a middle locating sections corresponding to the steel ball of the stop wall, the left locating section being formed in a position where the left stop face of the recess of the outer collar pushes the left dog, the right locating section being formed in apposition where the right stop face of the recess of the outer collar pushes the right dog, the middle locating section being formed in a position where neither the left stop face nor the right stop face of the recess of the outer collar pushes the left dog or the right dog, the steel ball being pushed into any of the three locating sections to locate the outer collar.

2. The ratchet structure of a screwdriver as claimed in claim 1, wherein the stop wall is formed with a left and a right abutting sections respectively corresponding to the left and right dogs, whereby when the left and right dogs are pushed by the left and right stop faces of the outer collar to disengage from the toothed section of the stem, the left and right dogs abut against the left and right abutting sections.

3. The ratchet structure of a screwdriver as claimed in claim 1, wherein one end of the stem extending out of the seat body has a bit connecting section for connecting with a bit.

* * * * *